US005169497A

United States Patent [19]

Sarkar et al.

[11] Patent Number: 5,169,497

[45] Date of Patent: Dec. 8, 1992

[54] APPLICATION OF ENZYMES AND FLOCCULANTS FOR ENHANCING THE FREENESS OF PAPER MAKING PULP

[75] Inventors: Jawed M. Sarkar, Naperville; David R. Cosper, Downers Grove, both of Ill.

[73] Assignee: Nalco Chemical Company, Naperville, Ill.

[21] Appl. No.: 772,726

[22] Filed: Oct. 7, 1991

[51] Int. Cl.[5] ..... D21H 21/10

[52] U.S. Cl. ..... 162/158; 162/9; 162/168.2; 162/168.3; 162/182; 162/72

[58] Field of Search ..... 162/9, 72 B, 158, 182, 162/168.2, 168.3

[56] References Cited

U.S. PATENT DOCUMENTS

| | | | |
|---|---|---|---|
| 3,406,089 | 10/1968 | Yerkes | 162/72 B |
| 4,894,119 | 1/1990 | Baron et al. | 162/168.2 |
| 4,923,565 | 5/1990 | Fuentes et al. | 162/72 B |

OTHER PUBLICATIONS

Abstract EP 351655.

Abstract TAPPI Journal 72 No. 6 pp. 187–191 Jun. 1989 (Eng.).

*Primary Examiner*—Peter Chin

*Attorney, Agent, or Firm*—Robert A. Miller; John G. Premo

[57] ABSTRACT

A process for improving freeness of paper pulp which comprises these steps:

a) Adding to the pulp at least 0.05% based on the dry weight of the pulp, of a cellulolytic enzyme;

b) Allowing the pulp to contact the cellulolytic enzyme for at least 20 minutes at a temperature of at least 20° C.;

c) Adding at least 0.0007% based on the dry weight of the pulp of a water soluble cationic polymer, and then d) Forming the thus treated pulp into paper.

6 Claims, 15 Drawing Sheets

APPLICATION OF ENZYMES AND FLOCCULANTS FOR ENHANCING THE FREENESS OF PAPER MAKING PULP

BACKGROUND OF THE INVENTION

A combination of cellulolytic enzymes in combination with cationic flocculants enhance the freeness of paper pulp.

INTRODUCTION

More and more the papermaking industry uses recycled papers. For example, for the manufacture of corrugated cardboard, more often raw materials are used which are based on recycled fibers and, at the same time, the number of recyclings is increased. With each recycling, the quality of the raw materials is lessened. To obtain a satisfactory level of mechanical characteristics, refining of the pulps in aqueous suspension is generally carried out, which leads to difficulties in runnability because of high concentrations of fines.

The pulps in aqueous suspension which are ready to be worked on a paper machine can be characterized by various parameters, one of which is particularly significant for predicting the draining capability of the pulp. A measure of the drainability of the pulp is frequently expressed in the term "freeness". Specifically, freeness is measured and is specifically designated Canadian standard freeness, CSF. CSF measures the drainage of 3 grams (oven dried weight) of pulp suspended in 1 liter of water. Since pulp slurry is not homogeneous, it is difficult to take an exact required weight of pulp equivalent to 3 grams. Therefore, at the time of freeness testing, with respect to the data hereafter presented, the consistency of pulp stock was determined by stirring well and then drained in a Buchner funnel. The pulp pad was dried at 105° C. to determine the exact weight of the pad. The CSF data hereafter, reported was corrected to a 0.3% consistency using the table of freeness corrections prepared by the pulp and paper Research Institute of Canada and has been described in TAPPI manual (T227). The CSF values were measured at 20° C.

While the invention produces particularly good results when used to treat pulps which contain substantial quantities of recycled fibers, also it has applicability in treating pulps which contain little or no recycled fibers.

THE DRAWINGS

The drawings illustrate the effect on Canadian Standard Freeness of enzyme and polymer dosage at various pHs and times of pulp contact with the enzymes.

Specifically:

THE INVENTION

Figure 1:
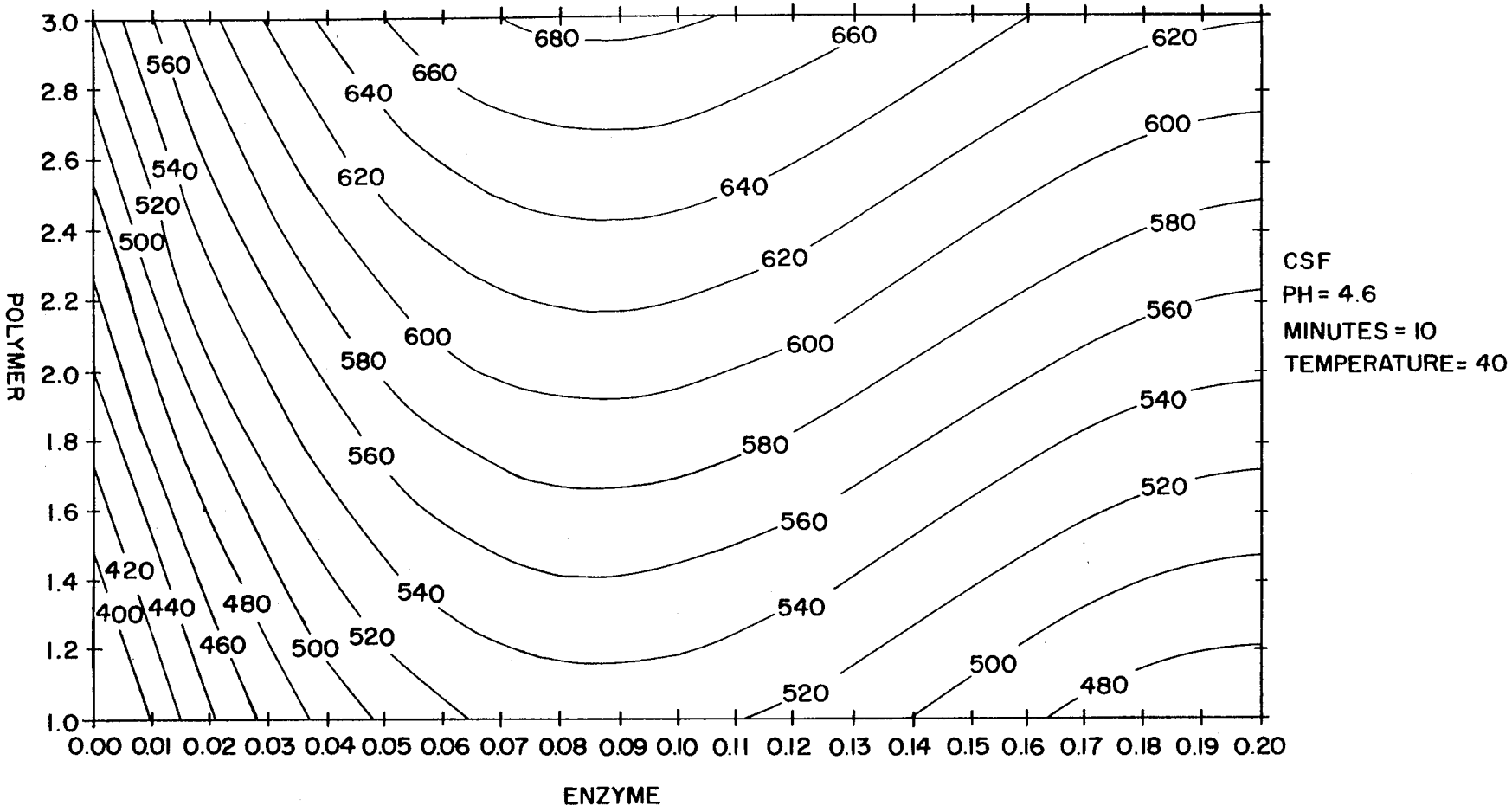
FIG. 1 shows the effect on CSF at pH 4.6 with an enzyme contact time of 10 minutes and at a temperature of 40° C.
Figure 2:
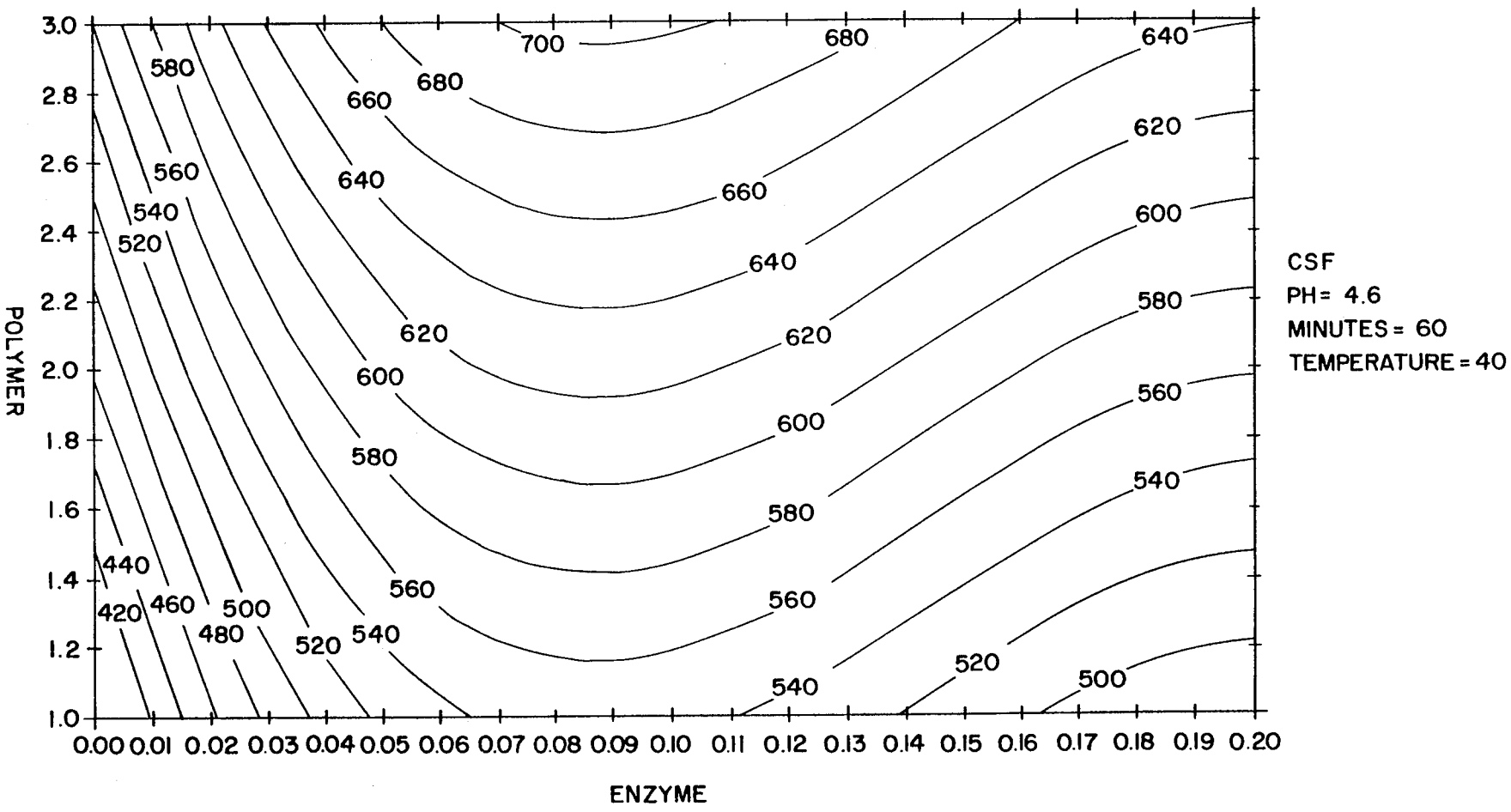
FIG. 2 shows the effect on CSF at pH 4.6 with an enzyme contact time of 60 minutes and at a temperature of 40° C.
Figure 3:
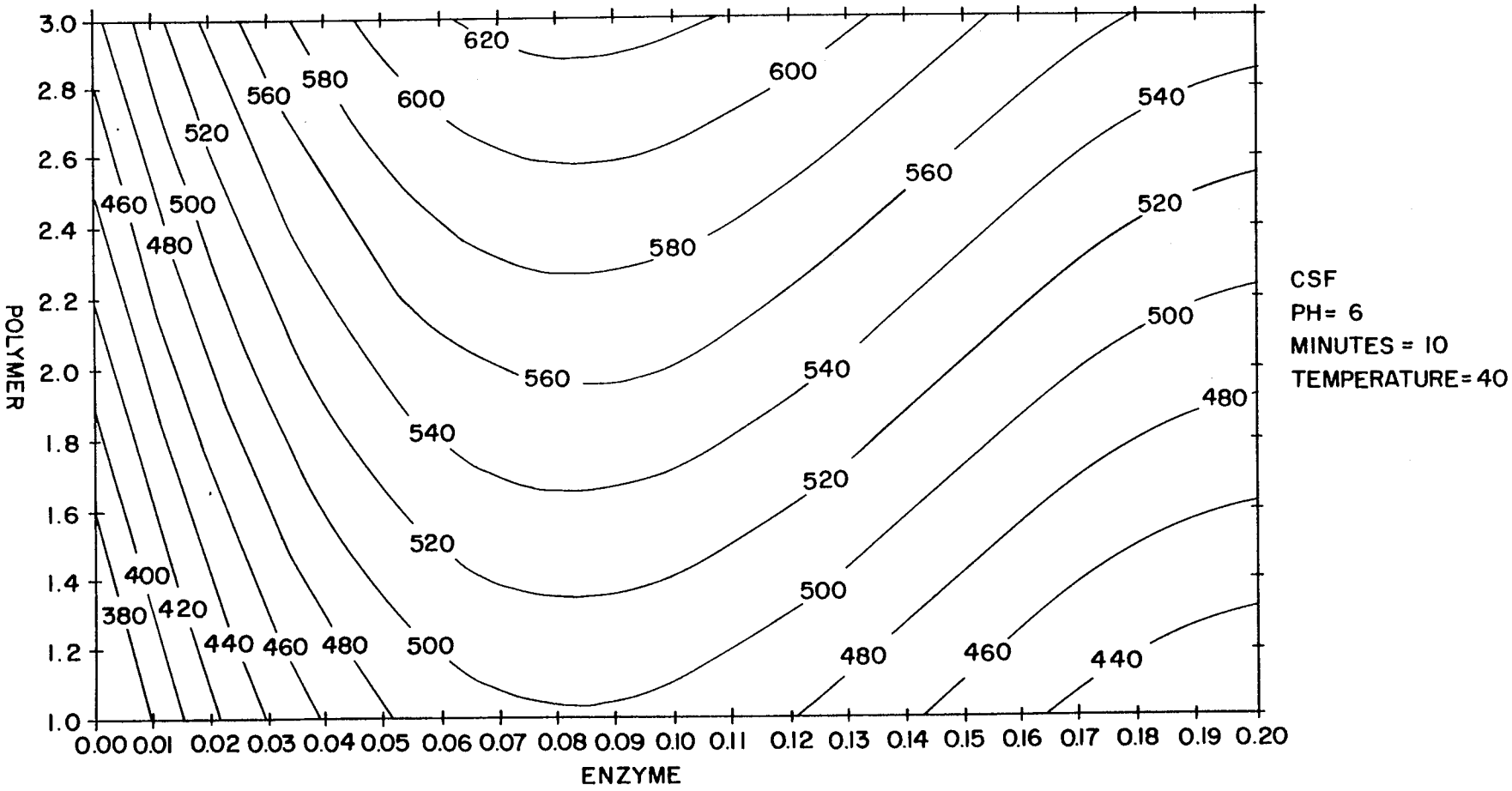
FIG. 3 shows the effect on CSF at pH 6 with an enzyme contact time of 10 minutes and at a temperature of 40° C.
Figure 4:
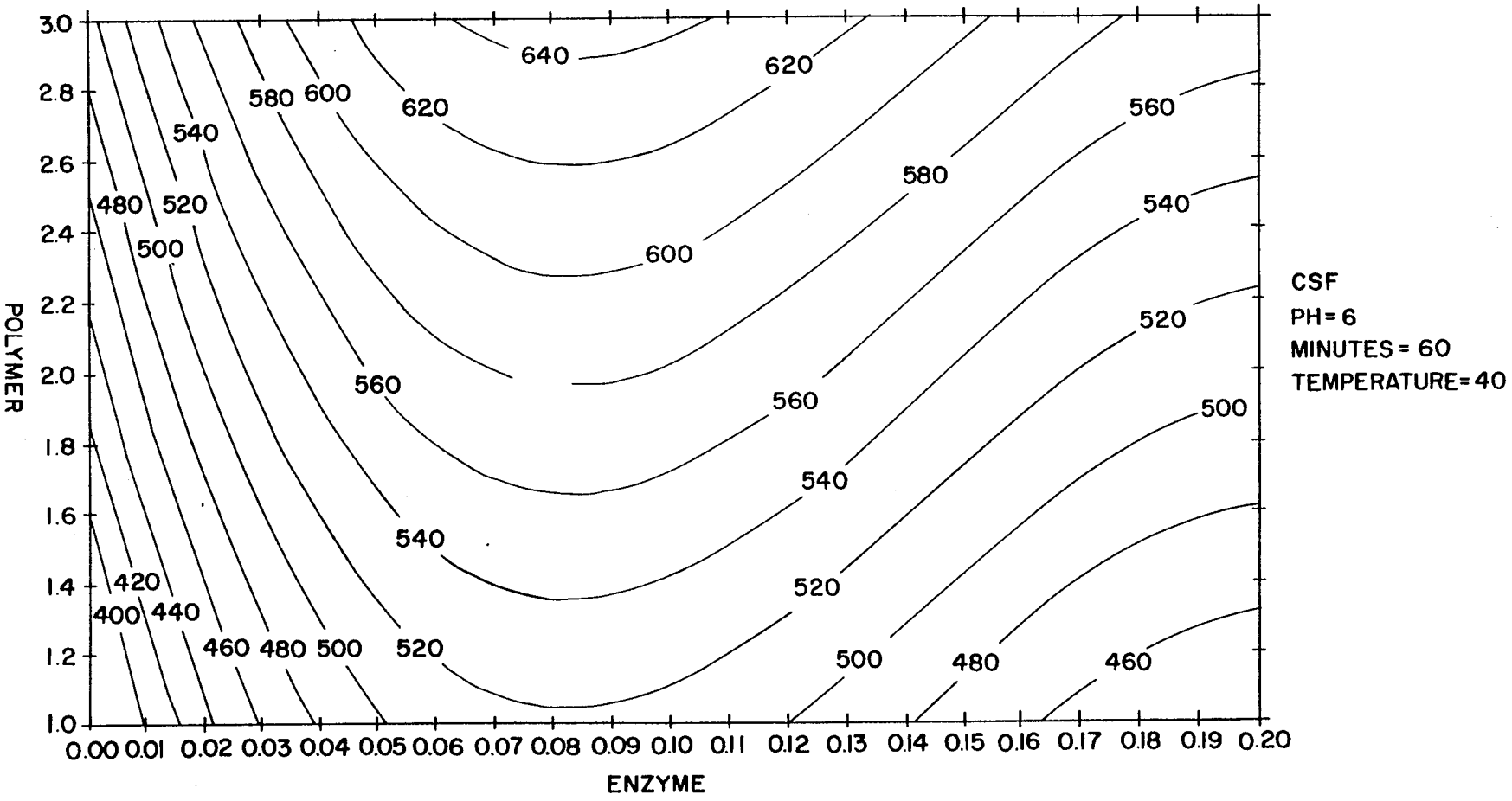
FIG. 4 shows the effect on CSF at pH 6 with an enzyme contact time of 60 minutes and at a temperature of 40° C.
Figure 5:
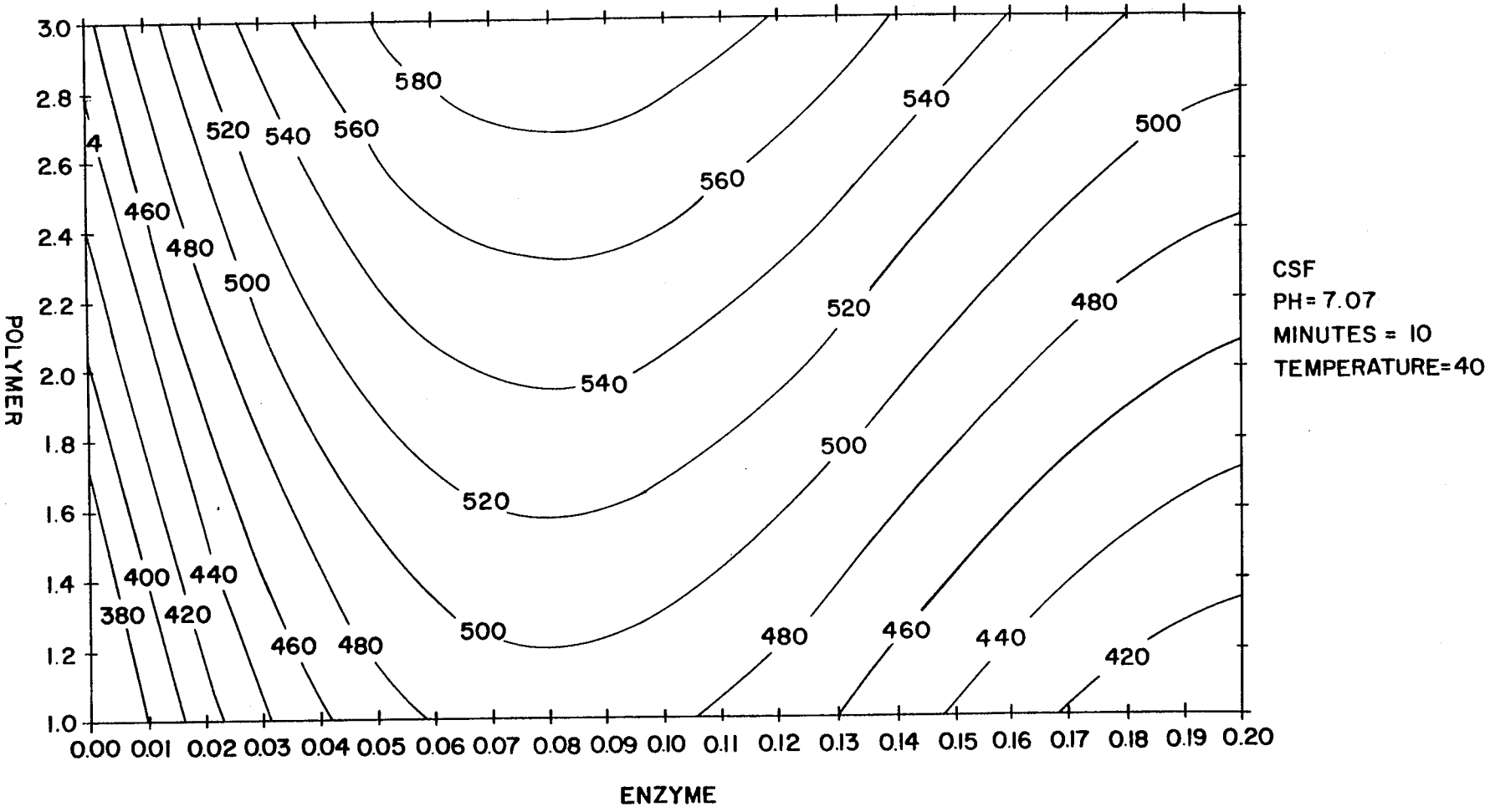
FIG. 5 shows the effect on CSF at pH 7.07 with an enzyme contact time of 10 minutes and at a temperature of 40° C.
Figure 6:
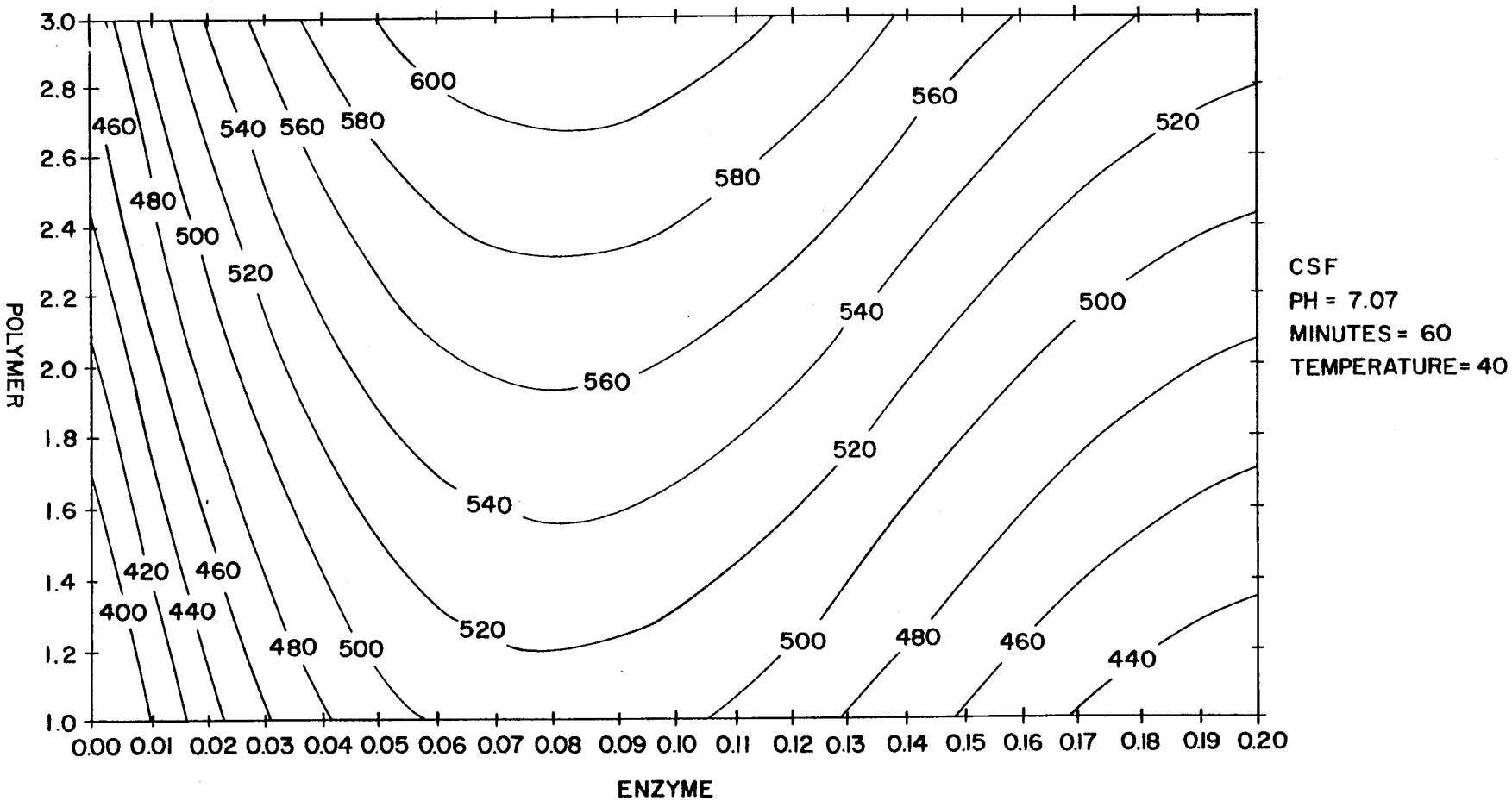
FIG. 6 shows the effect on CSF at pH 7.07 with an enzyme contact time of 60 minutes and at a temperature of 40° C.

The invention relates to a process for improving the freeness of paper pulp, which comprises the following sequential steps:

a) Adding to the pulp at least 0.05% based on the dry weight of the pulp, of a cellulolytic enzyme;
b) Allowing the pulp to contact the cellulolytic enzyme for at least 20 minutes at a temperature of at least 20° C.;
c) Adding at least 0.0007% based on the dry weight of the pulp of a water soluble cationic polymer, and then,
d) Forming the thus treated pulp into paper.

THE CELLULOLYTIC ENZYMES

Use of cellulolytic enzymes, e.g. the cellulases and/or the hemicellulases for treating recycled paper pulps to improve freeness for drainage characteristics is the subject of U.S. Pat. No. 4,923,565. The cellulase enzyme described in this patent may be used in the practice of the present invention.

Specific commercial cellulolytic enzymes are available and may be used in the practice of the invention.

THE CATIONIC WATER SOLUBLE POLYMERS

A variety of water soluble cationic flocculants may be used in the practice of the invention. Both condensation and vinyl addition polymers may be employed. For a relatively extensive list of water soluble cationic polymers, reference may be had to disclosure of Canadian patent 731,212, the disclosure of which is incorporated herein.

A preferred group of cationic polymers are the cationic polymers of acrylamide which in a more preferred embodiment of the invention, contain from 40–60% by weight of acrylamide. Larger or smaller amounts of acrylamide in the polymers may be used, e.g., between 30–80%. Typical of the cationic monomers, polymerized with acrylamide are the monomers diallyldimethyl ammonium chloride, (DADMAC), dimethylaminoethyl/acrylate·methyl chloride quaternary ammonium salt, (DMAEA.MCQ). When these cationic acrylamide polymers are used they should have a RSV (reduced specific viscosity) of at least 3 and preferably the RSV should be within the range of 5–20 or more. RSV was determined using a one molar sodium nitrate solution at 30° C. The concentration of the acrylamide polymer in this solution is 0.045%.

THE PAPER PULPS BEING TREATED

As indicated, the invention has utility in improving the drainage or the freeness of a wide variety of paper pulps, including both Kraft and other types of pulp. The invention, is particularly useful in treating pulps that contain recycled fibers. The effectiveness of the invention in improving drainage is most notable when the pulps contain at least 10% by weight of recycled fiber, with great improvements being evidenced when the recycled fiber content or the pulp being treated is at least 50% or more.

TREATMENT OF THE PULPS WITH THE ENZYMES AND CATIONIC POLYMERS

As indicated, the invention requires that the pulp first be treated with the enzyme and then with the cationic polymer. It is also important to the successful practice of the invention, that the conditions under which the treatment with the enzyme occurs is such to provide optimum reaction time of the enzyme with the pulp.

The treatment of the pulp with the enzyme is preferably conducted for a period of time not greater than 60 minutes. The minimum treating time is about 20 minutes. A typical treating time would be about 40 minutes. The pH of the pulp to achieve optimum results should be between the ranges of 4 and 8. The temperature of the treatment should not be below 20° C., and usually should not exceed 60° C. A typical average reaction temperature is favorably conducted is 40° C.

The preferred dosage of the polymer, as actives, is from 0.0026% to 0.0196% polymer based on the dry weight of the pulp. A general dosage which may be used to treat the pulp with the polymer is from 0.0007% to 0.0653% by weight.

The enzyme dosage based on the dry weight of the pulp in a preferred embodiment ranges from about 0.1 to about 10% by weight. A general treatment range of the enzyme that may be used is from 0.01 to 10% by weight.

It is obvious that in order for the enzyme to have sufficient reaction time and mixing described above, it is necessary that they be added to the pulp at the point in the paper making system to allow sufficient time for the above conditions to occur. Thus, a typical addition point in paper making system would be the machine chest. Other places where suitable contact time would occur may also be used as additional points.

The polymers, in our examples contain the following components:

Polymer 1: An acrylamide polymer containing 10 mole percent of DMAEA.MCQ. This polymer has an RSV of 17. It is in the form of an emulsion which contained approximately 26% by weight of polymeric ingredient.

Polymer 2: This polymer is a 34.8 percent by weight of active polymer ingredients in the form of a water-in-oil emulsion. It contains 50 weight per cent of DADMAC; copolymerized with acrylamide. The polymer has an RSV of 5.

Polymer 3: Polymer 3 is an acrylamide polymer containing 30 mole percent by weight, DMAEA-MCQ. It has an RSV of 19, the polymer is in the form of a water-in-oil emulsion being 29.6 percent by weight.

EXAMPLE 1

A. Response Surface Factorial Design I

A 30 run response surface factorial design Table 1 was setup, in which the effects of enzyme, polymer dosages, pH, time and temperature were simultaneously investigated on the freeness of pulp prepared using a mixture of old corrugated containers and newsprints (OCC and NP 75:25, polymer 1). The pulp slurry (3 g. dry weight) under these specified conditions was first treated under continuous agitation (250 rpm) with an enzyme solution of Celluclast 1:5 L (NOVO 0 to 20% based on dry weight of pulp), and then treated at 20° C. with Polymer 1 at a dosage of 0.0131 to 0.0392% on dry weight of pulp.

TABLE 1

| Polymer* | Enzyme | pH | Time | Temperature | Run Order | CSF Valves |
|---|---|---|---|---|---|---|
| 1 | 0 | 4.60 | 10 | 55° C. | 27 | 393.0 |
| 3 | 0 | 4.60 | 10 | 25° C. | 7 | 528.57 |
| 1 | .2 | 4.60 | 10 | 25° C. | 1 | 448.78 |
| 3 | .2 | 4.60 | 10 | 55° C. | 26 | 645.95 |
| 1 | 0 | 7.07 | 10 | 25° C. | 9 | 344.63 |
| 3 | 0 | 7.07 | 10 | 55° C. | 29 | 457.0 |
| 1 | .2 | 7.07 | 10 | 55° C. | 28 | 397.15 |
| 3 | .2 | 7.07 | 10 | 25° C. | 6 | 508.82 |
| 1 | 0 | 4.6 | 60 | 25° C. | 5 | 345.0 |
| 3 | 0 | 4.6 | 60 | 55° C. | 23 | 526.46 |
| 1 | .2 | 4.6 | 60 | 55° C. | 22 | 483.69 |
| 3 | .2 | 4.6 | 60 | 25° C. | 4 | 622.53 |
| 1 | 0 | 7.07 | 60 | 55° C. | 25 | 331.46 |
| 3 | 0 | 7.07 | 60 | 25° C. | 8 | 490.31 |
| 1 | .2 | 7.07 | 60 | 25° C. | 3 | 439.75 |
| 3 | .2 | 7.07 | 60 | 55° C. | 24 | 522.10 |
| 0 | .1 | 6 | 35 | 40° C. | 10 | 456.88 |
| 4 | .1 | 6 | 35 | 40° C. | 12 | 690.81 |
| 2 | 0 | 6 | 35 | 40° C. | 16 | 421.88 |
| 2 | .3 | 6 | 35 | 40° C. | 14 | 708.44 |
| 3 | .1 | 4.07 | 35 | 40° C. | 13 | 674.50 |
| 2 | .1 | 8.1 | 35 | 40° C. | 11 | 398.22 |
| 2 | .1 | 6 | 10 | 40° C. | 21 | 506.63 |
| 2 | .1 | 6 | 85 | 40° C. | 15 | 622.60 |
| 2 | .1 | 6 | 35 | 25° C. | 2 | 541.0 |
| 2 | .1 | 6 | 35 | 70° C. | 30 | 558.84 |
| 2 | .1 | 6 | 35 | 40° C. | 20 | 601.0 |
| 2 | .1 | 6 | 35 | 40° C. | 18 | 578.85 |
| 2 | .1 | 6 | 35 | 40° C. | 19 | 578.64 |
| 2 | .1 | 6 | 35 | 40° C. | 17 | 590.88 |

*Footnote:
To convert polymer lbs/ton to percent active, use the following equation (based on an active polymer ingredient of 26%):

$$\text{Polymer (lbs/ton)} * \frac{1 \text{ ton}}{2000 \text{ lbs}} * 26\%$$

A predictive equation was developed using all the experimental data. Statistical analysis of the data Table 2 and 3, resulted in a model with a R-Square value of 0.9662 and R-Square Adj. value of 0.9510. These values demonstrated the accuracy of the model used in this investigation. Data given in Tables 4, 5 and 6 are the initial setting of the experiments, and the theoretical optimal values obtained. The CSF values increased using separately Celluclast 1.5L (10% w/w) or polymer 0.0392% on dry weight of pulp). Using both cellulase and polymer increased the CSF from 240 to 717 ml. In contrast enzyme and polymer alone increased CSF from 240 to 462 and 550 ml respectively. FIGS. 1 to 6 showed steep curvatures with the increase of enzyme and polymer dosages, and the higher increase in freeness values was achieved at pH 4.6 compared to pH 6 and pH 7.

B. Response Surface Factorial Design 2

A 36 run response surface factorial design, Table 7 was setup where the effects of Celluclast 1.5L (0 to 0.4% based on dry weight of pulp) were determined. Polymer No. 1, (0 to 0.0392% on dry weight of pulp), and the enzyme reaction time (30, 45 and 60 min.) were simultaneously investigated on the freeness of the same pulp as mentioned in A. In this series of experiments, no buffer of any specific pH was used, as was used in all earlier series of experiments. The pH of the pulp suspension was found to be about 7, and was adjusted nearly to pH 4.8 by adding to pulp about 0.3 mL 6N sulfuric acid. Statistical analysis of the data, Table 8, 9 and 10 resulted in a model with R-Square value of 0.9928, without having revealed any direct positive interaction between enzyme and polymer.

TABLE 2

Least Squares Coefficients, Response C

| 0 Term | 1 Coeff. | 2 Std. Error | 3 T-value | 4 Signif. |
|---|---|---|---|---|
| 1 1 | 568.618689 | 6.728681 | 84.51 | 0.0001 |
| 2 ~P | 65.004913 | 4.772179 | 13.62 | 0.0001 |
| 3 ~E | −46.609390 | 10.126620 | −4.60 | 0.0002 |
| 4 ~M | 9.873872 | 5.081876 | 1.94 | 0.0662 |
| 5 ~P*PH | −14.785273 | 7.036308 | −2.10 | 0.0485 |
| 6 ~E*PH | −12.466267 | 7.053722 | −1.77 | 0.0924 |
| 7 ~PH*T | −13.709016 | 6.995056 | −1.96 | 0.0641 |
| 8 ~E**2 | −113.082895 | 8.900433 | −12.71 | 0.0001 |
| 9 ~E**3 | 85.671459 | 6.769722 | 12.66 | 0.0001 |
| 10 −PH**3 | −56.112785 | 5.538101 | −10.13 | 0.0001 |

| Term | 5 Transformed Term |
|---|---|
| 1 1 | |
| 2 ~P | (P-2) |
| 3 ~E | ((E-1e − 01)/1e − 01) |
| 4 ~M | ((M-3.5e + 01)/2.5e + 01) |
| 5 ~P*PH | (P-2)*((PH-6)/1.5) |
| 6 ~E*PH | ((E-1e − 01)/1e − 01)*((PH-6 |
| 7 ~PH*T | ((PH-6)/1.5)*((T-4e + 01)/ |
| 8 ~E**2 | ((E-1e − 01)/1e − 01)**2 |
| 9 ~E**3 | ((E-1e − 01)/1e − 01)**3 |
| 10 ~PH**3 | ((PH-6)/1.5)**3 |

No. cases = 30
R-sq. = 0.9662
RMS Error = 23.24
Resid. df = 20
R-sq-adj. = 0.9510
Cond. No. = 5.72
~indicates factors are transformed.

TABLE 3

Least Squares Summary ANOVA, Response C

| Source | 1 df | 2 Sum Sq. | 3 Mean Sq. | 4 F-Ratio | 5 Signif. |
|---|---|---|---|---|---|
| Total (Corr.) | 29 | 319441.1 | | | |
| Regression | 9 | 308637.5 | 34293.1 | 63.48 | 0.0000 |
| Linear | 3 | 113923.0 | 37974.3 | 70.30 | 0.0000 |
| Non-linear | 6 | 139205.5 | 23200.9 | 42.95 | 0.0000 |
| Residual | 20 | 10803.6 | 540.2 | | |
| Lack of fit | 17 | 10456.7 | 615.1 | 5.32 | 0.0969 |
| Pure error | 3 | 346.9 | 115.6 | | |

R-sq. = 0.9662
R-sq-adj. = 0.9510
7, 3) as large as 5.319 is a moderately rare event => some evidence of lack of fit.

TABLE 4

| Factor, Response or Formula | 1 Range | 2 Initial Setting | 3 Optimal Value |
|---|---|---|---|
| Factors | | | |
| POLYMER | 0 | | 0 |
| ENZYME | 0 to .20 | 0.1 | 0.082558 |
| PH | 4.5 to 7.5 | 6 | 6.6764 |
| MINUTES | 10 to 60 | 35 | 59.962 |
| TEMPERATURE | 40 | | 40 |

TABLE 4-continued

| Factor, Response or Formula | 1 Range | 2 Initial Setting | 3 Optimal Value |
|---|---|---|---|
| Responses | | | |
| CSF | MAX | | 461.87 |

Converged to a tolerance of 0.0377 after 32 steps.

TABLE 5

| Factor, Response Formula | 1 Range | 2 Initial Setting | 3 Optimal Value |
|---|---|---|---|
| Factors | | | |
| POLYMER | 1 to 3 | 2 | 2.9998 |
| ENZYME | 0 | | 0 |
| PH | 4.5 to 7.5 | 6 | 4.5011 |
| MINUTES | 10 to 60 | 35 | 59.998 |
| TEMPERATURE | 40 | | 40 |
| Responses | | | |
| CSF | MAX | | 549.64 |

Converged to a tolerance of 0.0377 after 138 steps.

TABLE 6

| Factor, Response or Formula | 1 Range | 2 Initial Setting | 3 Optimal Value |
|---|---|---|---|
| 1 Factors | | | |
| 2 POLYMER | 1 to 3 | 2 | 2.999 |
| 3 ENZYME | 0 to .20 | 0.1 | 0.08707 |
| 4 PH | 4.5 to 7.5 | 6 | 4.5013 |
| 5 MINUTES | 10 to 60 | 35 | 59.989 |
| 6 TEMPERATURE | 40 | | 40 |
| 7 | | | |
| 8 Responses | | | |
| 9 CSF | MAX | | 716.5 |

Converged to a tolerance of 0.0377 after 110 steps.

TABLE 7

| | 1 POLYMER | 2 ENZYME | 3 TIME | 4 pH | 5 CSF |
|---|---|---|---|---|---|
| 1 | 0.0 | 0.000 | 30 | 4.76 | 242.00 |
| 2 | 0.0 | 0.002 | 30 | 4.80 | 263.80 |
| 3 | 0.0 | 0.004 | 30 | 4.64 | 306.00 |
| 4 | 1.5 | 0.000 | 30 | 4.91 | 407.00 |
| 5 | 1.5 | 0.004 | 30 | 4.86 | 478.16 |
| 6 | 3.0 | 0.000 | 30 | 4.67 | 524.75 |
| 7 | 3.0 | 0.002 | 30 | 4.68 | 550.60 |
| 8 | 3.0 | 0.004 | 30 | 4.73 | 545.00 |
| 9 | 1.5 | 0.002 | 30 | 4.76 | 438.58 |
| 10 | 1.5 | 0.002 | 30 | 4.86 | 434.60 |
| 11 | 1.5 | 0.002 | 30 | 4.60 | 428.61 |
| 12 | 1.5 | 0.002 | 30 | 4.95 | 442.87 |
| 13 | 0.0 | 0.000 | 45 | 4.76 | 252.00 |
| 14 | 0.0 | 0.002 | 45 | 4.76 | 266.70 |
| 15 | 0.0 | 0.004 | 45 | 4.72 | 315.70 |
| 16 | 1.5 | 0.000 | 45 | 4.75 | 410.00 |
| 17 | 1.5 | 0.004 | 45 | 4.67 | 482.52 |
| 18 | 3.0 | 0.000 | 45 | 4.72 | 516.75 |
| 19 | 3.0 | 0.002 | 45 | 4.81 | 555.28 |
| 20 | 3.0 | 0.004 | 45 | 4.70 | 565.41 |
| 21 | 1.5 | 0.002 | 45 | 4.59 | 450.31 |
| 22 | 1.5 | 0.002 | 45 | 4.74 | 449.00 |
| 23 | 1.5 | 0.002 | 45 | 4.63 | 450.12 |
| 24 | 1.5 | 0.002 | 45 | 4.81 | 450.50 |
| 25 | 0.0 | 0.000 | 60 | 4.91 | 245.00 |
| 26 | 0.0 | 0.002 | 60 | 4.78 | 290.50 |
| 27 | 0.0 | 0.004 | 60 | 4.60 | 324.80 |
| 28 | 1.5 | 0.000 | 60 | 4.58 | 413.70 |
| 29 | 1.5 | 0.004 | 60 | 4.74 | 493.60 |
| 30 | 3.0 | 0.000 | 60 | 4.67 | 526.80 |
| 31 | 3.0 | 0.002 | 60 | 4.81 | 563.90 |
| 32 | 3.0 | 0.004 | 60 | 4.76 | 571.10 |
| 33 | 1.5 | 0.002 | 60 | 4.84 | 450.20 |
| 34 | 1.5 | 0.002 | 60 | 4.81 | 449.70 |
| 35 | 1.5 | 0.002 | 60 | 4.90 | 448.60 |
| 36 | 1.5 | 0.002 | 60 | 4.90 | 452.40 |

TABLE 8

Least Squares Coefficients, Response C. Model JAW_REG1

| Term | 1 Coeff. | 2 Std. Error | 3 T-value | 4 Signif. |
|---|---|---|---|---|
| 1 1 | 447.393686 | 3.427031 | 130.55 | 0.0001 |
| 2 ~P | 133.857931 | 2.395596 | 55.88 | 0.0001 |
| 3 ~E | 30.714437 | 2.679827 | 11.46 | 0.0001 |
| 4 ~T | 6.878700 | 1.759408 | 3.91 | 0.0008 |
| 5 ~PH | 2.173969 | 3.570057 | 0.61 | 0.5491 |
| 6 ~P*E | −7.869880 | 2.797020 | −2.81 | 0.0104 |
| 7 ~P*T | −1.231124 | 2.719064 | −0.45 | 0.6554 |
| 8 ~P*PH | 2.349784 | 7.511788 | 0.31 | 0.7575 |
| 9 ~E*T | 4.340487 | 2.786138 | 1.56 | 0.1342 |
| 0 ~E*PH | 3.716614 | 5.719449 | 0.65 | 0.5229 |
| 1 ~T*PH | 0.439370 | 3.617493 | 0.12 | 0.9045 |
| 2 ~P**2 | −32.617088 | 3.531662 | −9.24 | 0.0001 |
| 3 ~E**2 | −0.037503 | 3.396388 | −0.01 | 0.9913 |
| 4 ~T**2 | −2.162876 | 3.474620 | −0.62 | 0.5403 |
| 5 ~PH**2 | 0.261631 | 6.253606 | 0.04 | 0.9670 |

| Term | 5 Transformed Term |
|---|---|
| 1 1 | |
| 2 ~P | ((P-1.5)/1.5) |
| 3 ~E | ((E-2e − 03)/2e − 03) |
| 4 ~T | ((T-4.5e + 01)/1.5e + 01) |
| 5 ~PH | ((PH-4.765)/1.85e − 01) |
| 6 ~P*E | ((P-1.5)/1.5)*((E-2e − 03) |
| 7 ~P*T | ((P-1.5)/1.5)*((T-4.5e + 0 |
| 8 ~P*PH | ((P-1.5)/1.5)*((PH-4.765 |
| 9 ~E*T | ((E-2e − 03)/2e − 03)*((T-4. |
| 0 ~E*PH | ((E-2e − 03)/2e − 03)*((PH-4 |
| 1 ~T*PH | ((T-4.5e + 01)/1.5e + 01)*(( |
| 2 ~P**2 | ((P-1.5)/1.5)**2 |
| 3 ~E**2 | ((E-2e − 03)/2e − 03)**2 |
| 4 ~T**2 | ((T-4.5e + 01)/1.5e + 01)**2 |
| 5 ~PH**2 | ((PH-4.765)/1.85e − 01)**2 |

o. cases = 36
R-sq. = 0.9957
RMS Error = 8.522
esid. df = 21
R-sq-adj. = 0.9928
Cond. No. = 5.784
indicates factors are transformed.

TABLE 9

Least Squares Coefficients, Response $log_C.

| Term | 1 Coeff. | 2 Std. Error | 3 T-value | 4 Signif. |
|---|---|---|---|---|
| 1 | 6.099356 | 0.003720 | 1639.80 | 0.0001 |
| ~P | 0.343841 | 0.004153 | 82.79 | 0.0001 |
| ~E | 0.075537 | 0.004354 | 17.35 | 0.0001 |
| ~T | 0.016980 | 0.003227 | 5.26 | 0.0001 |
| ~P*E | −0.040127 | 0.004945 | −8.12 | 0.0001 |
| ~P*T | −0.010994 | 0.004770 | −2.30 | 0.0288 |
| ~P*PH | 0.028204 | 0.012556 | 2.25 | 0.0328 |
| ~P**2 | −0.134348 | 0.005304 | −25.33 | 0.0001 |

| Term | 5 Transformed Term |
|---|---|
| 1 | |
| ~P | ((P-1.5)/1.5) |
| ~E | ((E-2e − 03)/2e − 03) |
| ~T | ((T-4.5e + 01)/1.5e + 01) |
| ~P*E | ((P-1.5)/1.5)*((E-2e − 03) |
| ~P*T | ((P-1.5)/1.5)*((T-4.5e + 0 |
| ~P*PH | ((P-1.5)/1.5)*((PH-4.765 |
| ~P**2 | ((P-1.5)/1.5)**2 |

o. cases = 36
R-sq. = 0.9971
RMS Error = 0.01578
esid. df = 28
R-sq-adj. = 0.9964
Cond. No. = 2.544
indicates factors are transformed.

TABLE 10

Least Squares Summary ANOVA, Response

| Source | 1 df | 2 Sum Sq. | 3 Mean Sq. | 4 F-Ratio | 5 Signif. |
|---|---|---|---|---|---|
| Total (Corr.) | 35 | 2.400112 | | | |
| Regression | 7 | 2.393139 | 0.341877 | 1373.00 | 0.0000 |

TABLE 10-continued

Least Squares Summary ANOVA, Response

| Source | 1 df | 2 Sum Sq. | 3 Mean Sq. | 4 F-Ratio | 5 Signif. |
|---|---|---|---|---|---|
| Linear | 3 | 2.067889 | 0.689296 | 2768.00 | 0.0000 |
| Non-linear | 4 | 0.191848 | 0.047962 | 192.60 | 0.0000 |
| Residual | 28 | 0.006973 | 0.000249 | | |
| Lack of fit | 27 | 0.006937 | 0.000257 | 7.22 | 0.2873 |
| Pure error | 1 | 0.000036 | 0.000036 | | |

R-sq. = 0.9971
R-sq-adj. = 0.9964
(27, 1) as large as 7.222 is not a rare event => no evidence of lack of fit.

Figure 7:
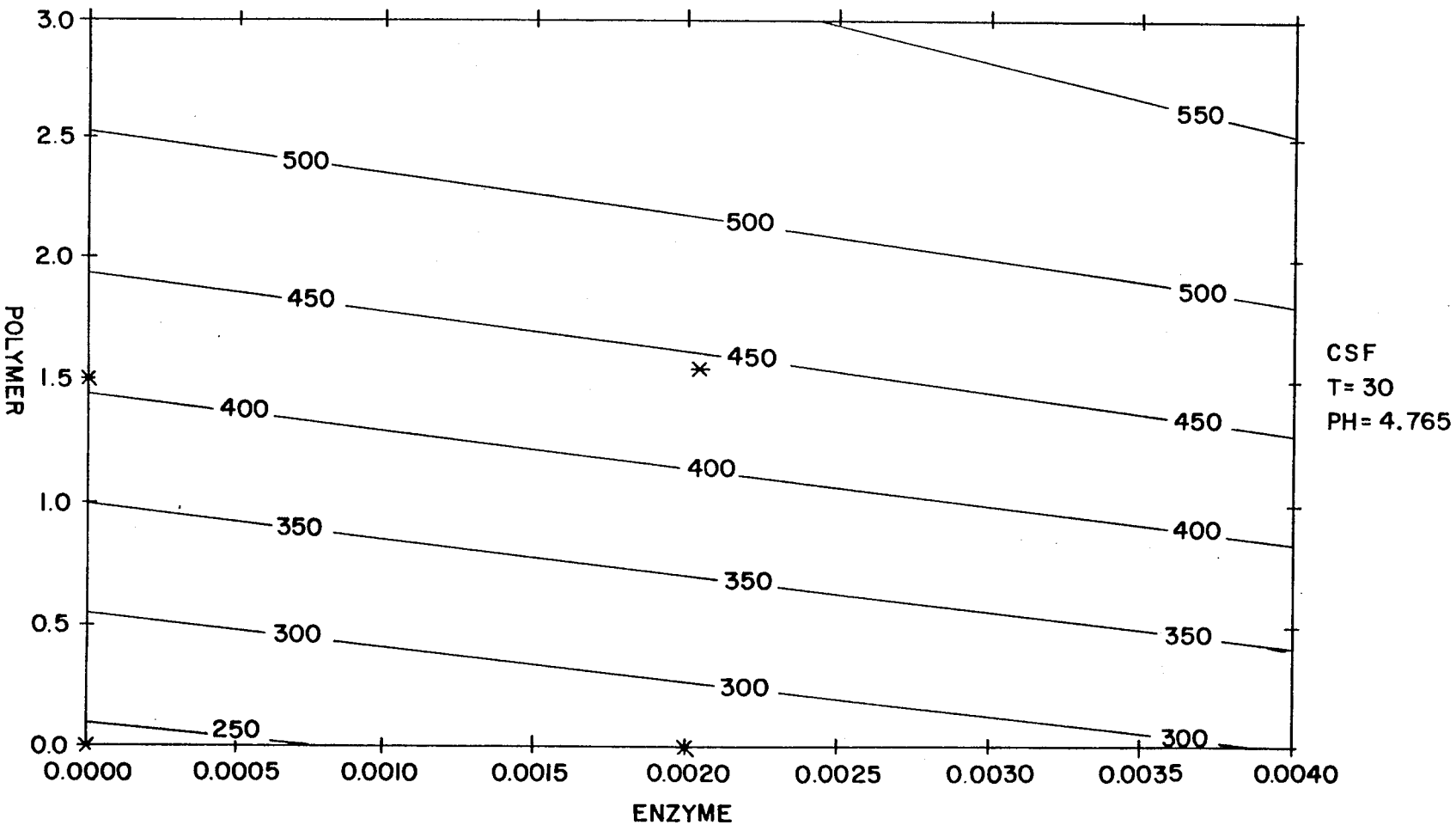
FIG. 7 shows the effect on CSF at pH 4.765 with an enzyme contact time of 30 minutes at a temperature of 30° C.
Figure 8:
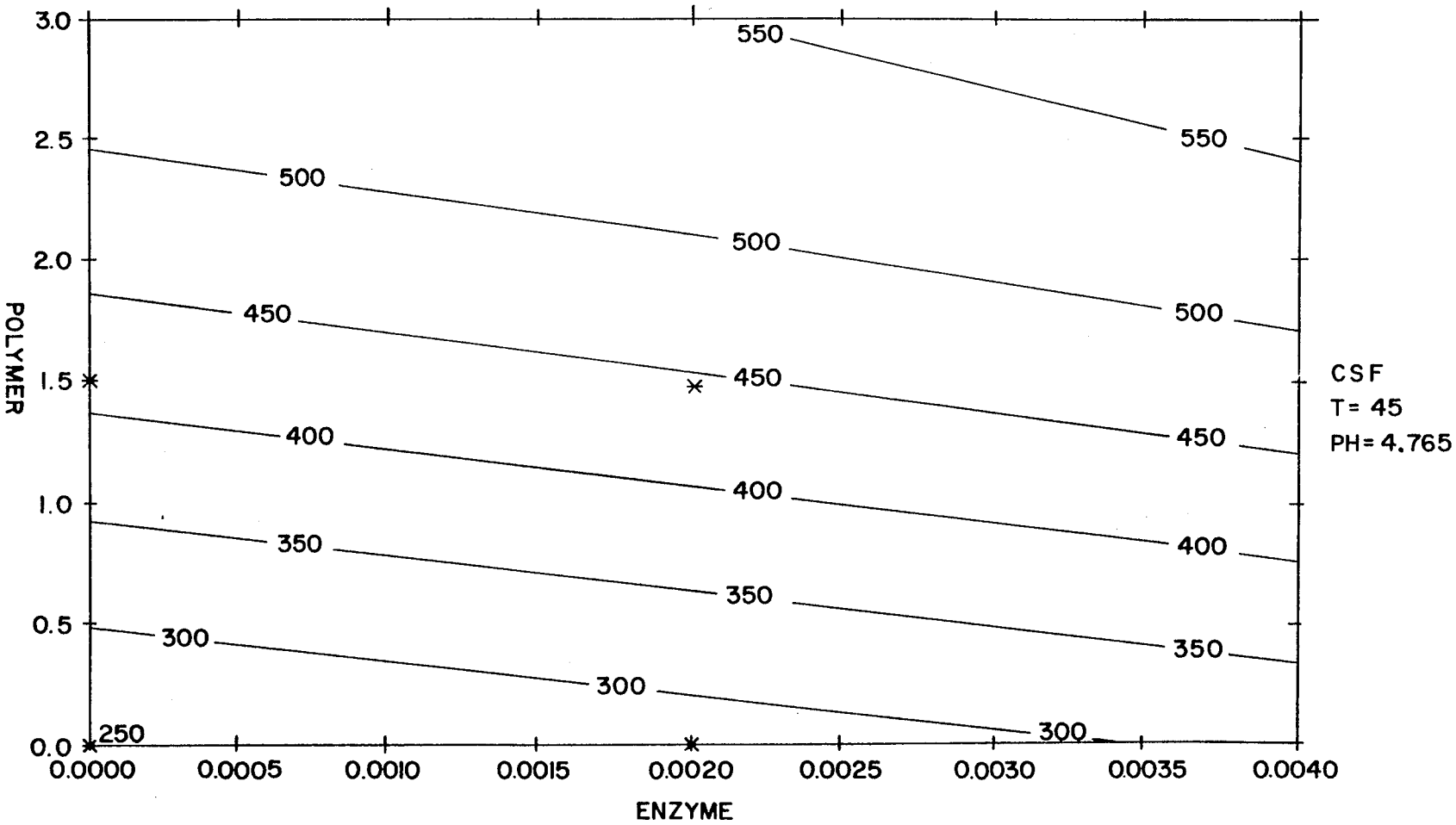
FIG. 8 shows the effect on CSF at pH 4.768 with an enzyme contact time of 45 minutes at a temperature of 45° C.
Figure 9:
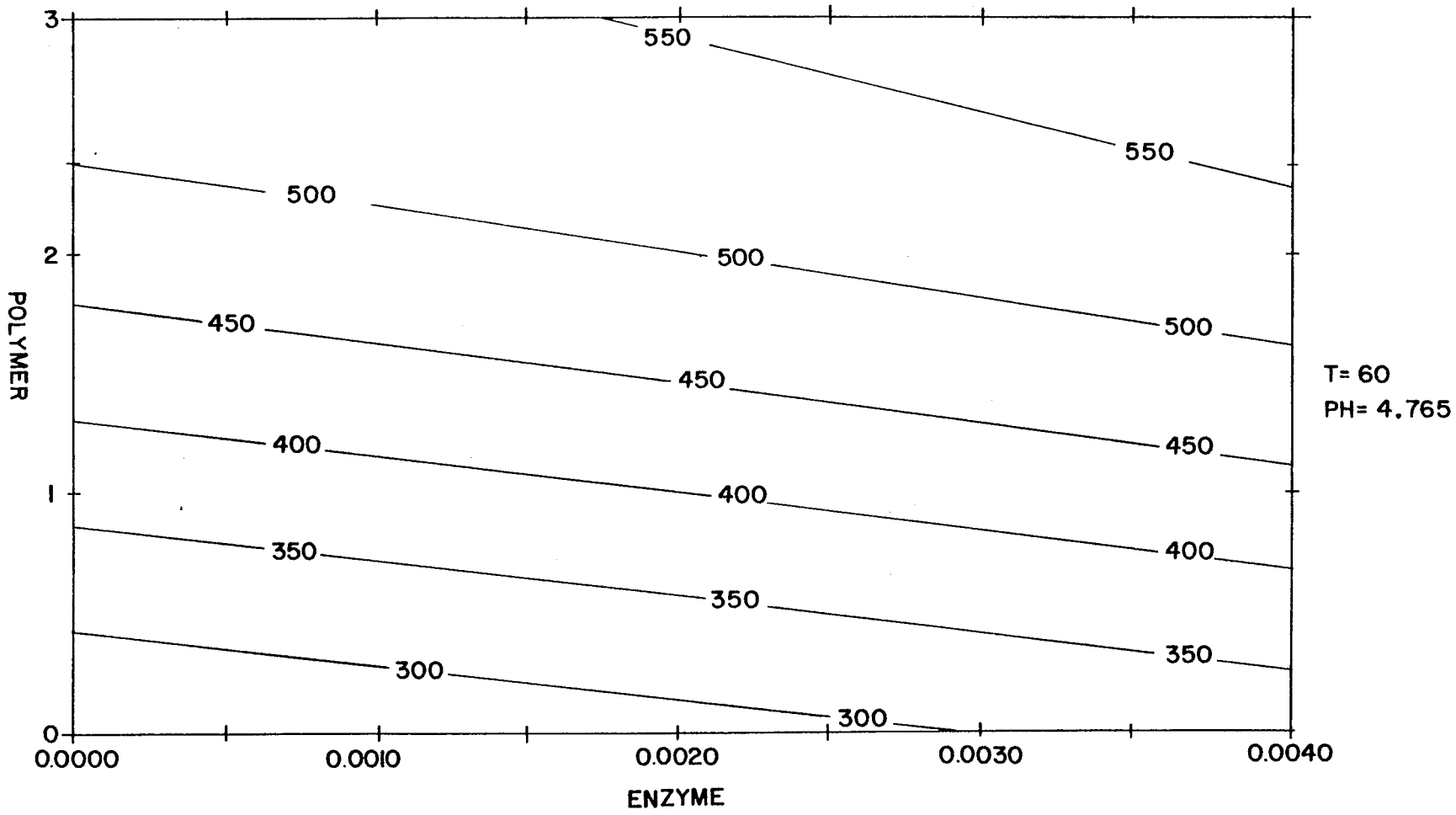
FIG. 9 shows the effect on CSF at pH 4.768 with an enzyme contact time of 60 minutes at a temperature of 60° C.
Figure 10:
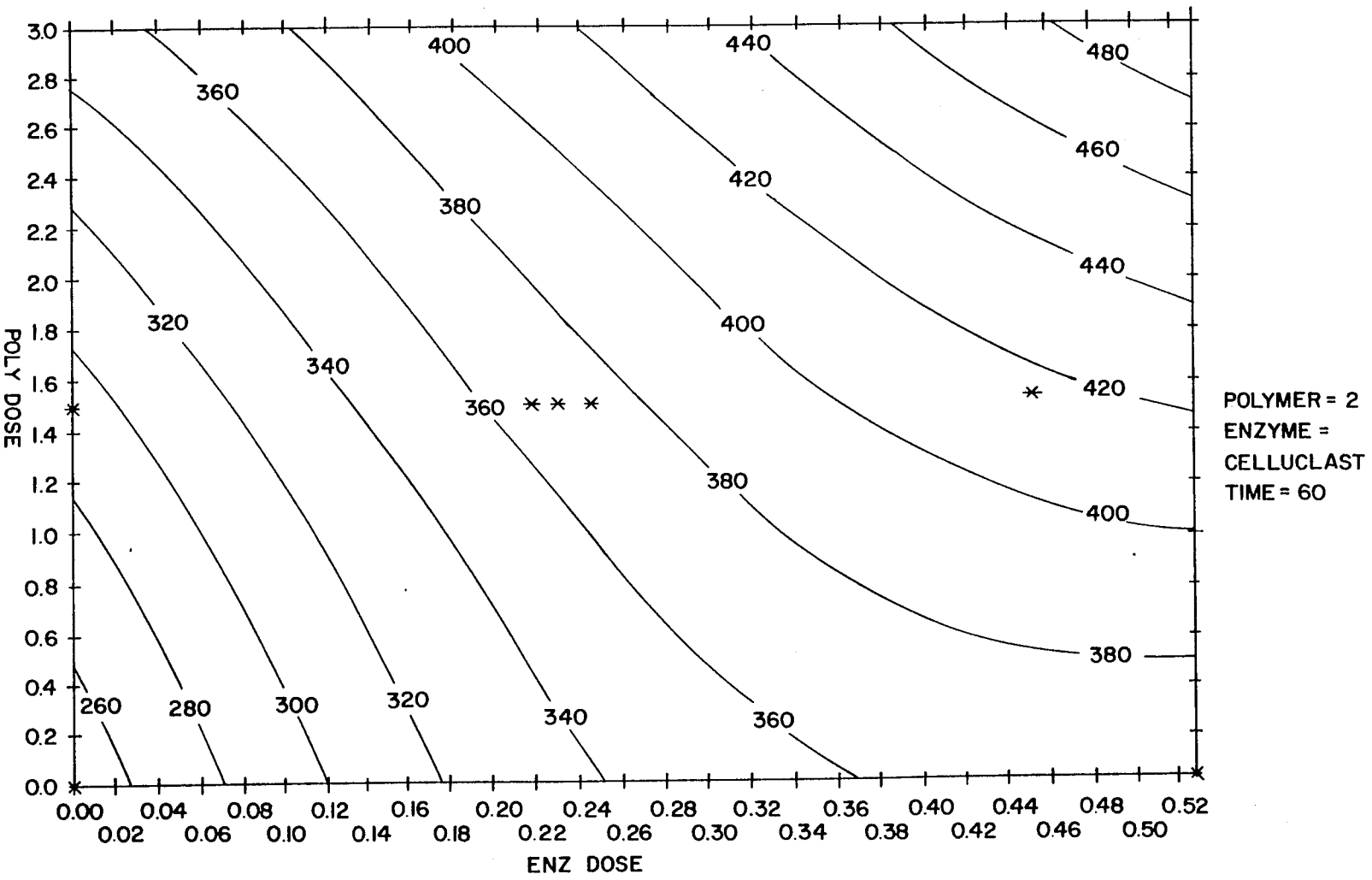
FIGS. 10–15 show the effects on CSF of various polymer enzyme combinations.

Table 11 contains the data of initial setting of experiment and the theoretical values obtained. The pretreatment of the pulp suspension with Celluclast 1.5L (0.4% based on dry weight of pulp), followed by the treatment with polymer (0.0392% on dry weight of pulp), resulted in the increase of freeness from 242 mL to 570 mL, while when the pulp suspension was pretreated with reduced dosages of Celluclast 1.5L and polymer (0.2% and 0.0196% on dry weight of pulp, respectively, the freeness increased from 242 to 450 mL. In contract, the freeness increased to 407 and 550 mL by only treatment with polymer dosages of 0.0196% and 0.0392% respective, (FIGS. 7, 8 and 9).

TABLE 11

| 0 Factor, Response or Formula | 1 Range | 2 Initial Setting | 3 Optimal Value |
|---|---|---|---|
| 1 Factors | | | |
| 2 POLYMER | 0 to 3 | 1.5 | 2.9992 |
| 3 ENZYME | 0 to 0.004 | 0.002 | 0.003997 |
| 4 T | 30 to 60 | 45 | 42.495 |
| 5 PH | 4.765 | | 4.765 |
| 6 | | | |
| 7 Responses | | | |
| 8 CSF | MAX | | 568.6 |

Converged to a tolerance of 0.0329 after 48 steps.

EXAMPLE 2

Enzyme Polymer Application In Pulp And Paper Industry

A. Source of Recycled Fiber

The pulp slurry consisting mainly of old corrugated containers (OCC) was obtained from a midwestern recycle mill. The pulp stock was diluted with tap water and the freeness (Canadian Standard Freeness) measured. The freeness of this pulp was 350 mL. In order to examine the effect of enzymes and polymers on the freeness of pulp, the freeness of pulp was decreased from 350 mL to 250 mL by beating it using a Valley Beater.

B. Treatment of Pulp with Celluclast (NOVO) and Polymer No. 2

A response surface design, Table 12, was setup in which the effects of enzyme and polymer dosages was investigated on the freeness of pulp. The pulp slurry (about 3 g. dry weight) which had a pH of 5.05 was first treated for 60 min. at 45° C. under continuous agitation (250 rpm) with an enzyme solution of Celluclast 1.5 L (0 to 0.5% based on dry weight of pulp) and then treated at 20° C. with polymer No. 2, 0.261% and 0.0522%. The R-Square adjusted value of the fit was 0.9706: Table 13. This value demonstrated the accuracy of the model used in this investigation. The freeness values, using separately either Celluclast (0.46% wt/wt basis) or Polymer 1 (0.0522%) were increased from 241 to 365 and 350, respectively. But when the enzyme pretreated pulp was further treated with polymer, the freeness increased from 241 to 497 mL, Table 14.

TABLE 12

| POLYMER = 91PD030 ENZYME = CELLUCLAST TIME = 60 | | | |
|---|---|---|---|
| 0 | 1 Poly_Dose | 2 Enz_Dose | 3 CSF |
| 1 | 0.0 | 0.000 | 241.4 |
| 2 | 0.0 | 0.234 | 342.4 |
| 3 | 0.0 | 0.528 | 361.7 |
| 4 | 1.5 | 0.000 | 302.0 |
| 5 | 1.5 | 0.454 | 420.5 |
| 6 | 3.0 | 0.000 | 344.6 |
| 7 | 3.0 | 0.225 | 424.3 |
| 8 | 3.0 | 0.447 | 474.2 |
| 9 | 1.5 | 0.218 | 364.0 |
| 10 | 1.5 | 0.231 | 367.0 |
| 11 | 1.5 | 0.201 | 365.0 |
| 12 | 1.5 | 0.245 | 360.0 |

TABLE 13

| Least Squares Coefficients, Response C. | | | | |
|---|---|---|---|---|
| 0 Term | 1 Coeff. | 2 Std. Error | 3 T-value | 4 Signif. |
| 1 1 | 378.519410 | 4.625556 | 81.83 | 0.0001 |
| 2 ~P | 42.201910 | 7.112547 | 5.93 | 0.0019 |
| 3 ~E | 65.965186 | 5.082299 | 12.98 | 0.0001 |
| 4 ~P*E | 7.570605 | 5.951252 | 1.27 | 0.2593 |
| 5 ~P**2 | 6.602749 | 6.374128 | 1.04 | 0.3477 |
| 6 ~E**2 | −20.846166 | 7.985141 | −2.61 | 0.0476 |
| 7 ~P*E**2 | 17.220552 | 10.397590 | 1.66 | 0.1586 |

| 0 Term | 5 Transformed Term |
|---|---|
| 1 1 | |
| 2 ~P | ((P-1.5)/1.5) |
| 3 ~E | ((E-2.64e − 01)/2.64e − 01) |
| 4 ~P*E | ((P-1.5)/1.5)*((E-2.64e − |
| 5 ~P**2 | ((P-1.5)/1.5)**2 |
| 6 ~E**2 | ((E-2.64e − 01)/2.64e − 01)* |
| 7 ~P*E**2 | ((P-1.5)/1.5)*((E-2.64e − |

No. cases = 12
R-sq. = 0.9866
RMS Error = 10.17
Resid. df = 5
R-sq-adj. = 0.9706
Cond. No. = 3.935
~indicates factors are transformed.

TABLE 14

| 0 Factor, Response or Formula | 1 Range | 2 Initial Setting | 3 Optimal Value | |
|---|---|---|---|---|
| Factors | | | | ENZYME |
| POLY_DOSE | 0 | | 0 | ONLY |
| ENZ_DOSE | 0 to 0.528 | 0.264 | 0.462 | |
| Responses | | | | |
| CSF | MAX | | 365.3 | |
| Factors | | | | POLYMER |
| POLY_DOSE | 0 TO 3 | 1.5 | 3 | ONLY |
| ENZ_DOSE | 0 | | 0 | |
| Responses | | | | |
| CSF | MAX | | 350.16 | |
| Factors | | | | POLYMER |
| POLY_DOSE | 0 to 3 | 1.5 | 2.9982 | AND |
| ENZ_DOSE | 0 to 0.528 | 0.264 | 0.52788 | ENZYME |
| Responses | | | | |
| CSF | MAX | | 497.11 | |

Converged to a tolerance of 0.0233 after 5 steps.

C. Treatment of Pulp with Celluclast and Polymer No. 3

A 24 response surface design, Table 15 was setup in which the effects of enzyme, polymer dosages, enzyme reaction time were investigated on the freeness of pulp. The pulp slurry was first treated with enzyme and then with polymer as described above. The R-Square adjusted value was 0.9978 (Table 16). The pretreatment of pulp suspension with Celluclast (0.485% based on dry weight of pulp, reaction time—100 min.) followed by the treatment of polymer No. 3, 0.0444% on dry weight of pulp, resulted in the increase of freeness from 250 mL to 675 mL. When the pulp suspension was pretreated with reduced dosages of Celluclast and polymer (0.28% and 0.0222%, respectively) the freeness increased from 250 to 528 mL. No difference in freeness values were found when pulp was pretreated with enzyme for 60 or 100 minutes.

D. Treatment of Pulp with Celluclast and Polymer No. 1

Figure 11:
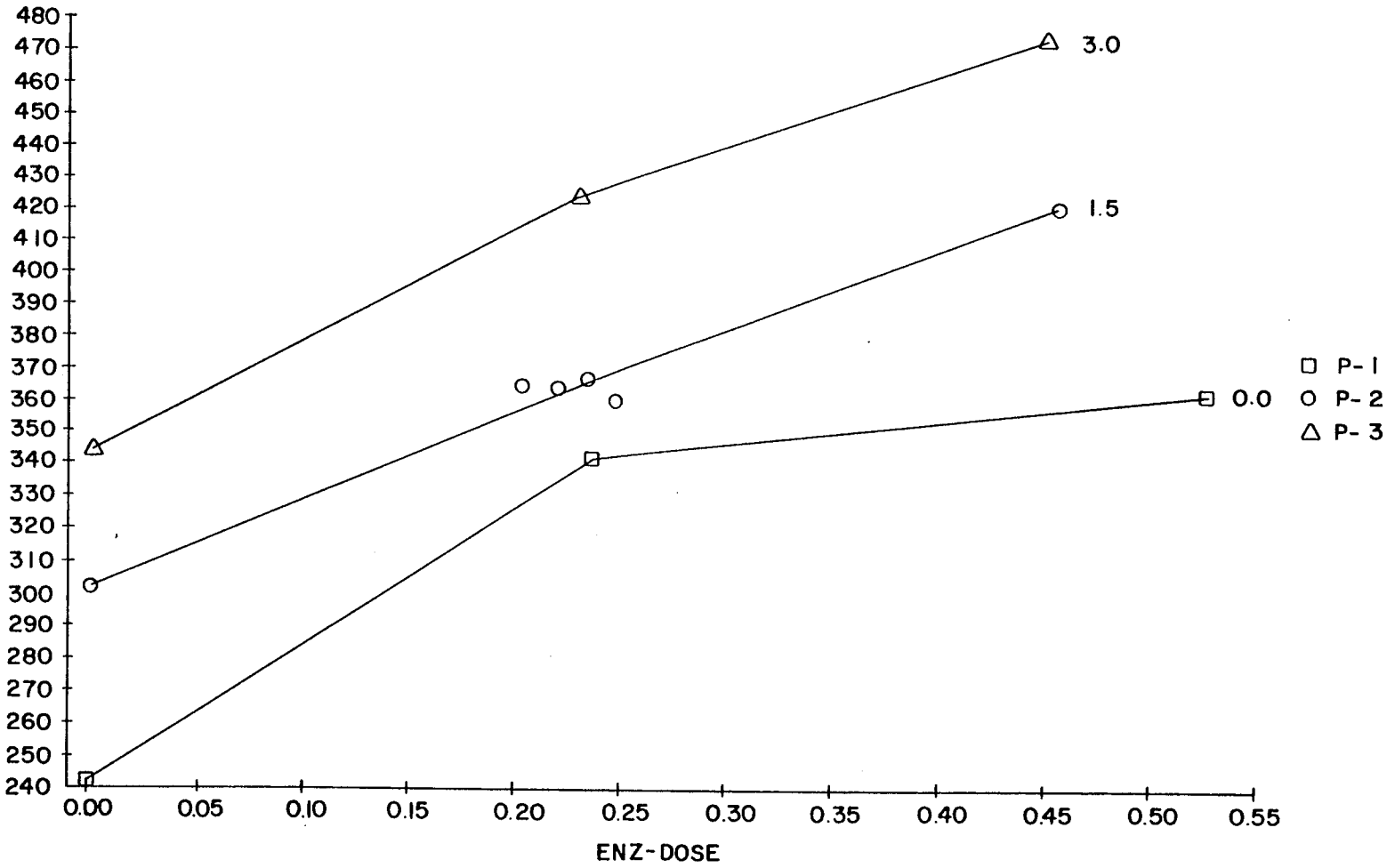
Figure 12:
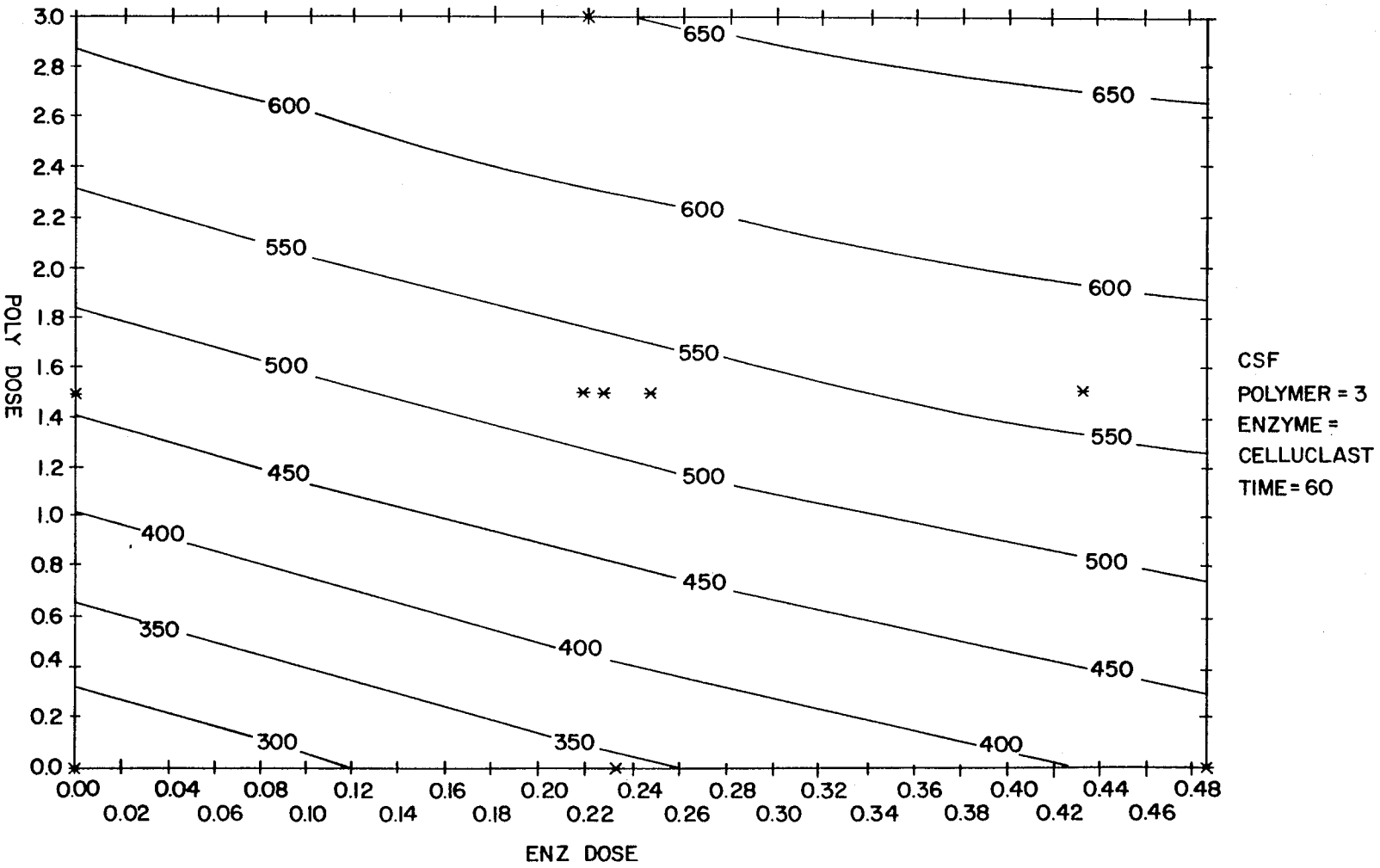
Figure 13:
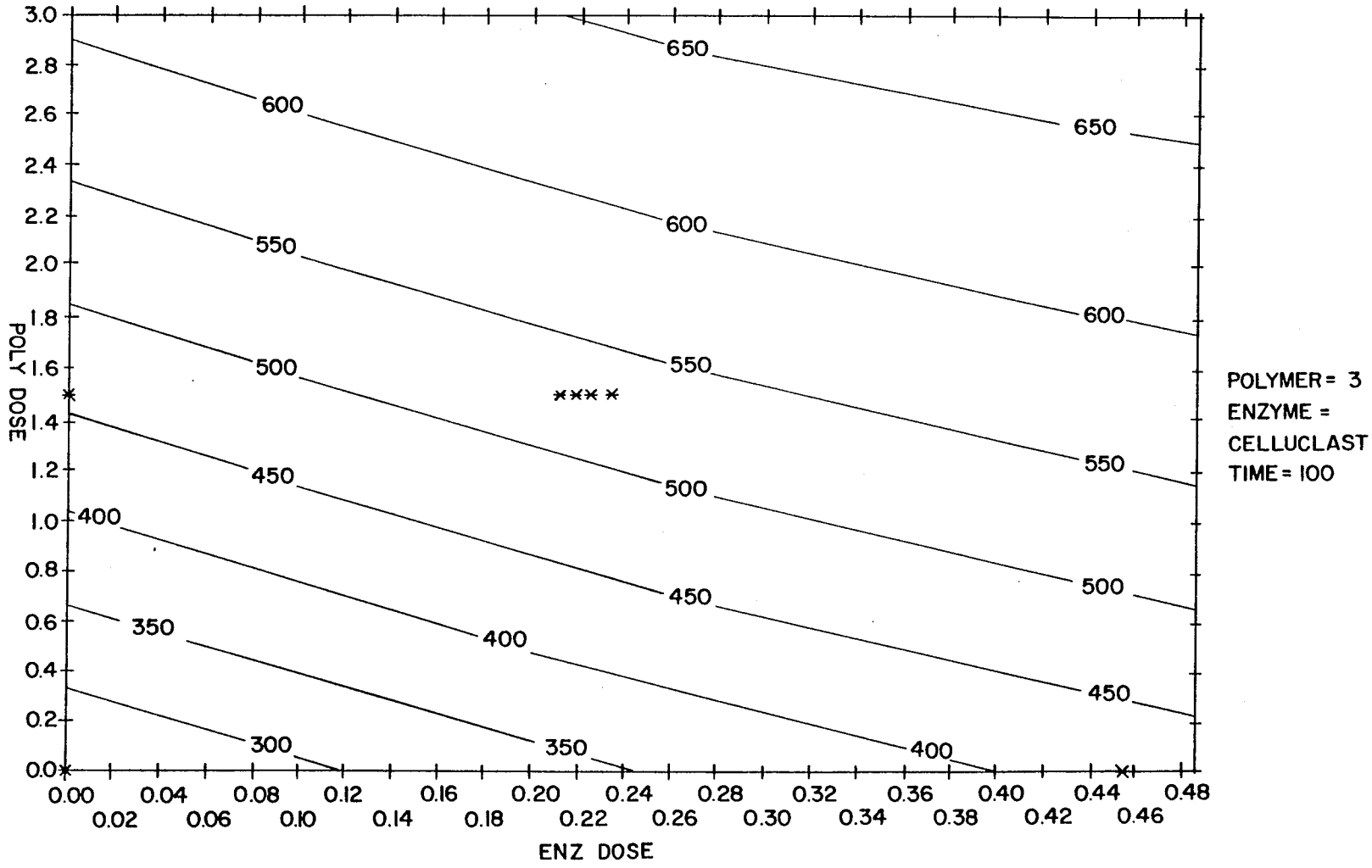
Figure 14:
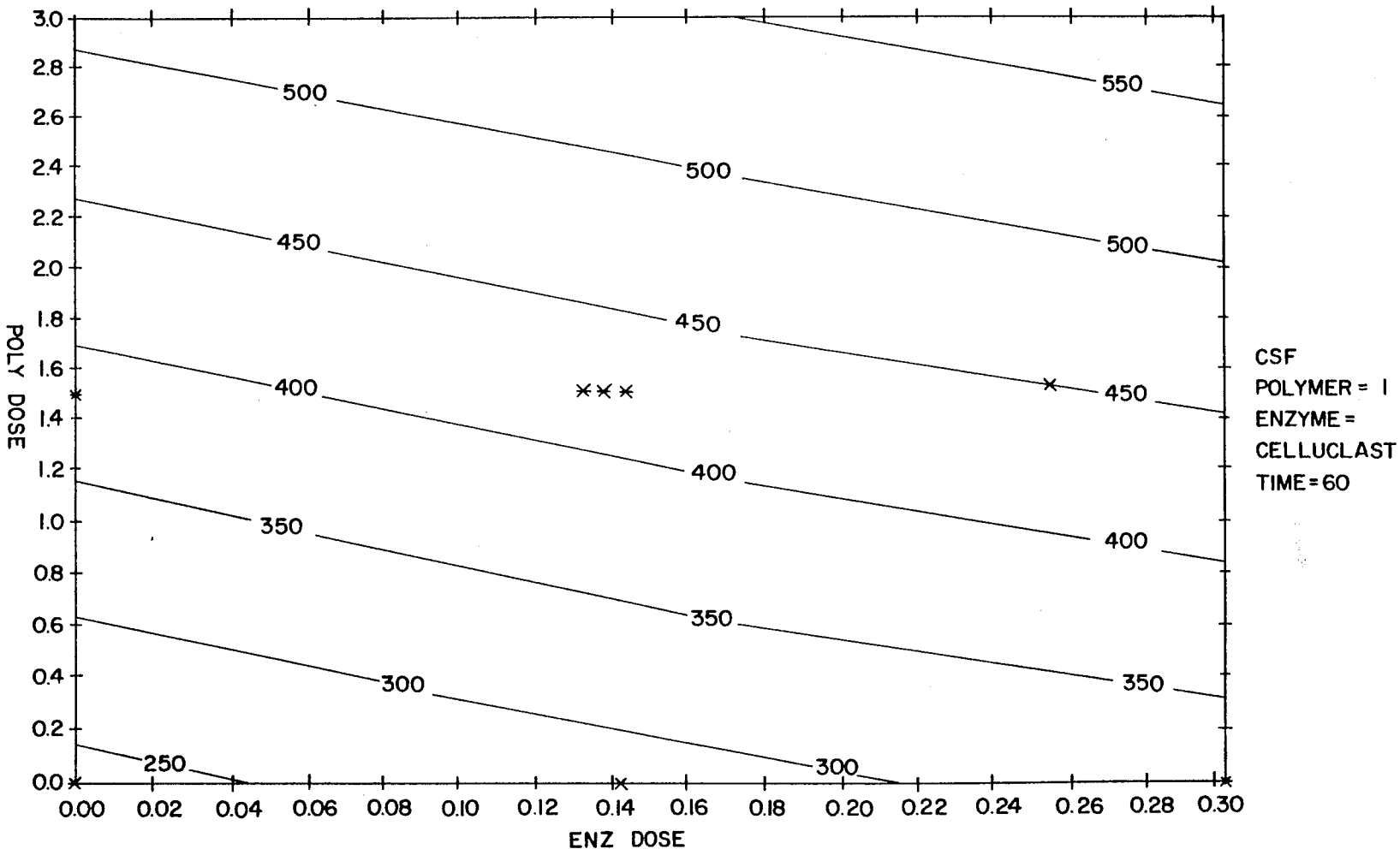
Figure 15:
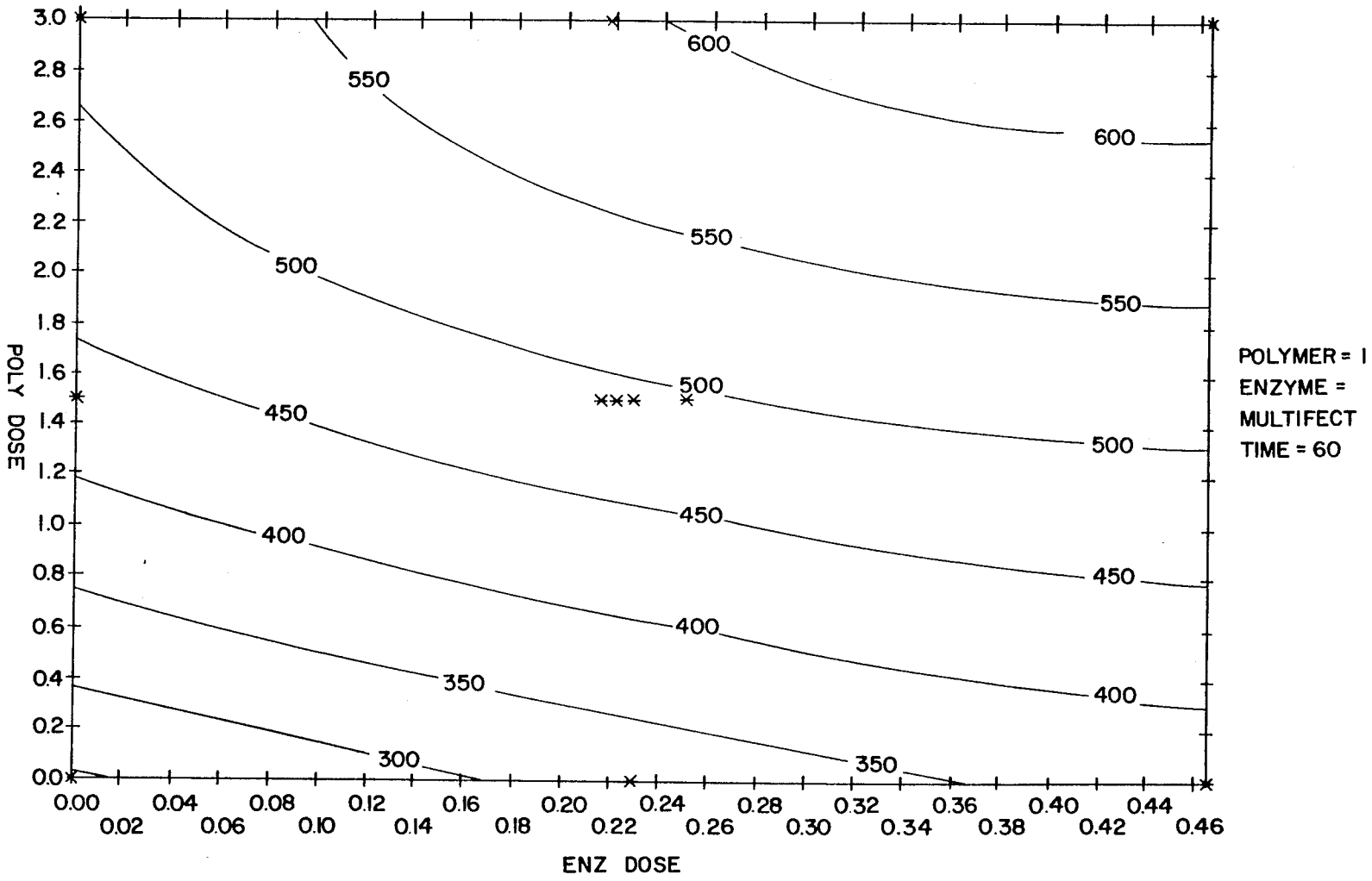

(Example 1) shows the effect of Celluclast 1.5L and polymer No. 1 on various laboratory prepared recycled fibers. When these investigations were extended to a mill recycled fiber similar results were obtained. A 12-run response surface design (Table 17) was set up in which the effects of enzyme and polymer dosages were investigated exactly as described above. Statistical analysis of the data, Table 18 and 19 resulted in a model with an R-Square adjusted value of 0.9994. The pretreatment of the pulp suspension with Celluclast (0.3% based on dry weight of pulp, 60 min., reaction time) followed by treatment of the polymer NO. 1 0.0392% resulted in the increase of freeness from 235 mL to 574 mL, while when the pulp suspension was pretreated with reduced dosages of Celluclast and polymer (0.14% and 0.0196 respectively), the freeness increased from 235 mL to 428 mL. (FIG. 11).

TABLE 15

| POLYMER = 3 ENZYME = CELLUCLAST | | | | |
|---|---|---|---|---|
| 0 | 1 Poly_Dose | 2 Enz_Dose | 3 Minute | 4 CSF |
| 1 | 0.0 | 0.0000 | 60 | 250.00 |
| 2 | 0.0 | 0.2326 | 60 | 337.20 |
| 3 | 0.0 | 0.4858 | 60 | 422.50 |
| 4 | 1.5 | 0.0000 | 60 | 464.00 |
| 5 | 1.5 | 0.4332 | 60 | 558.00 |
| 6 | 3.0 | 0.0000 | 60 | 608.00 |
| 7 | 3.0 | 0.2198 | 60 | 654.00 |
| 8 | 3.0 | 0.4528 | 60 | 664.00 |
| 9 | 1.5 | 0.2182 | 60 | 528.00 |
| 10 | 1.5 | 0.2264 | 60 | 526.25 |
| 11 | 1.5 | 0.2469 | 60 | 525.00 |
| 12 | 1.5 | 0.2182 | 60 | 522.50 |
| 13 | 0.0 | 0.0000 | 100 | 251.00 |
| 14 | 0.0 | 0.2449 | 100 | 339.00 |
| 15 | 0.0 | 0.4563 | 100 | 418.00 |
| 16 | 1.5 | 0.0000 | 100 | 458.00 |
| 17 | 1.5 | 0.4688 | 100 | 575.00 |
| 18 | 3.0 | 0.0000 | 100 | 604.00 |
| 19 | 3.0 | 0.2290 | 100 | 653.00 |
| 20 | 3.0 | 0.4494 | 100 | 676.00 |
| 21 | 1.5 | 0.2247 | 100 | 528.00 |
| 22 | 1.5 | 0.2182 | 100 | 529.00 |
| 23 | 1.5 | 0.2344 | 100 | 531.00 |
| 24 | 1.5 | 0.2120 | 100 | 536.00 |

TABLE 16

| Least Squares Coefficients, Response C, | | | | |
|---|---|---|---|---|
| 0 Term | 1 Coeff. | 2 Std. Error | 3 T-value | 4 Signif. |
| 1 1 | 516.739319 | 9.237230 | 55.94 | 0.0001 |
| 2 ~P | 153.135457 | 1.626186 | 94.17 | 0.0001 |
| 3 ~E | 35.134252 | 13.626143 | 2.58 | 0.0202 |
| 4 ~P*E | −27.201967 | 2.094032 | −12.99 | 0.0001 |
| 5 ~P**2 | −31.786505 | 2.445110 | −13.00 | 0.0001 |
| 6 ~E**2 | −12.540811 | 2.731146 | −4.59 | 0.0003 |

TABLE 16-continued

| Least Squares Coefficients, Response C, | | | | |
|---|---|---|---|---|
| 7 ~M | 1.645517 | 1.020927 | 1.61 | 0.1266 |
| 8 ~E*M | 2.589306 | 1.522845 | 1.70 | 0.1084 |

| 0 Term | 5 Transformed Term |
|---|---|
| 1 1 | |
| 2 ~P | ((P-1.5)/1.5) |
| 3 ~E | ((E-2.428999e − 01)/2.4289 |
| 4 ~P*E | ((P-1.5)/1.5)*((E-2.4289 |
| 5 ~P**2 | ((P-1.5)/1.5)**2 |
| 6 ~E**2 | ((E-2.428999e − 01)/2.4289 |
| 7 ~M | SQRT(M) |
| 8 ~E*M | ((E-2.428999e − 01)/2.4289 |

No. cases = 24
R-sq. = 0.9985
RMS Error = 5.613
Resid. df = 16
R-sq-adj. = 0.9978
Cond. No. = 21.42
~indicates factors are transformed.

TABLE 17

| POLYMER = 2 ENZYME = CELLUCLAST TIME = 60 | | | |
|---|---|---|---|
| 0 | 1 Poly_Dose | 2 Enz_Dose | 3 CSF |
| 1 | 0.0 | 0.0000 | 235.0 |
| 2 | 0.0 | 0.1412 | 279.2 |
| 3 | 0.0 | 0.3008 | 321.0 |
| 4 | 1.5 | 0.0000 | 385.0 |
| 5 | 1.5 | 0.2597 | 448.2 |
| 6 | 3.0 | 0.0000 | 509.0 |
| 7 | 3.0 | 0.1412 | 546.0 |
| 8 | 3.0 | 0.2778 | 570.0 |
| 9 | 1.5 | 0.1395 | 419.0 |
| 10 | 1.5 | 0.1493 | 428.0 |
| 11 | 1.5 | 0.1432 | 422.0 |
| 12 | 1.5 | 0.1429 | 420.0 |

TABLE 18

| Least Squares Coefficients, Response | | | | |
|---|---|---|---|---|
| 0 Term | 1 Coeff. | 2 Std. Error | 3 T-value | 4 Signif. |
| 1 1 | 424.186960 | 1.131305 | 374.95 | 0.0001 |
| 2 ~P | 132.144409 | 1.042865 | 126.71 | 0.0001 |
| 3 ~E | 37.101858 | 1.144858 | 32.41 | 0.0001 |
| 4 ~P*E | −5.338573 | 1.331804 | −4.01 | 0.0071 |
| 5 ~P**2 | −10.086667 | 1.610348 | −6.26 | 0.0008 |
| 6 ~E**2 | −4. 028245 | 1.822527 | −2.21 | 0.0691 |

| 0 Term | 5 Transformed Term |
|---|---|
| 1 1 | |
| 2 ~P | ((P-1.5)/1.5) |
| 3 ~E | ((E-1.504e − 01)/1.504e − 01 |
| 4 ~P*E | ((P-1.5)/1.5)*((E-1.504e |
| 5 ~P**2 | ((P-1.5)/1.5)**2 |
| 6 ~E**2 | ((E-1.504e − 01)/1.504e − 01 |

No. cases = 12
R-sq. = 0.9997
RMS Error = 2.537
Resid. df = 6
R-sq-adj. = 0.9994
Cond. No. = 2.937
~indicates factors are transformed.

TABLE 19

| Least Squares Summary ANOVA, Response | | | | | |
|---|---|---|---|---|---|
| 0 Source | 1 df | 2 Sum Sq. | 3 Mean Sq. | 4 F-Ratio | 5 Signif. |
| 1 Total (Corr.) | 11 | 111960.4 | | | |
| 2 Regression | 5 | 111921.8 | 22384.4 | 3478.00 | 0.0000 |
| 3 Linear | 2 | 107622.3 | 53811.1 | 8360.00 | 0.0000 |
| 4 Non-linear | 3 | 514.8 | 171.6 | 26.66 | 0.0007 |
| 5 Residual | 6 | 38.6 | 6.4 | | |

R-sq. = 0.9997
R-sq-adj. = 0.9994

E. Treatment of Pulp with Multifect CL (GENENCOR) and Polymer No. 1 10 mole % DMAEA-MCQ/AcAMm RSV=17

Although cellulolytic enzymes of Novo and Genecor have comparable International Endoglucanase Units (IEU), their origin and the other components present in them are quite different. A 12 response surface design (Table 20) was set-up similar to Celluclast as mentioned above. Slightly higher freeness values were obtained with Multifect CL compared to Celluclast 1.5L. This is simply due to higher Multifect dosages (0.2185% to 0.46512%), compared to Celluclast (0.1412% to 0.2778%). Statistical analysis of the data (Table 21) resulted in a model with an R-Square adjusted value of 0.9956. The freeness values increased using separately either Multifect (0.46% wt/wt basis) or polymer (0.0392%) were from 245 to 371 and 508 mL, respectively. But when enzyme pretreated pulp was further treated with polymer, the freeness increased from 245 mL to 634 mL. (Table 22)

TABLE 20

| POLYMER = 2 ZYME = MULTIFECT TIME = 60 | | | |
|---|---|---|---|
| 0 | 1 Poly_Dose | 2 Enz_Dose | 3 CSF |
| 1 | 0.0 | 0.00000 | 245.4 |
| 2 | 0.0 | 0.22901 | 319.8 |
| 3 | 0.0 | 0.46512 | 366.2 |
| 4 | 1.5 | 0.00000 | 436.0 |
| 5 | 1.5 | 0.43636 | 521.0 |
| 6 | 3.0 | 0.00000 | 503.0 |
| 7 | 3.0 | 0.21818 | 598.0 |
| 8 | 3.0 | 0.46512 | 635.0 |
| 9 | 1.5 | 0.22642 | 484.4 |
| 10 | 1.5 | 0.22305 | 484.0 |
| 11 | 1.5 | 0.25000 | 501.0 |
| 12 | 1.5 | 0.22989 | 487.0 |

TABLE 21

| Least Squares Coefficients, Response | | | | |
|---|---|---|---|---|
| 0 Term | 1 Coeff. | 2 Std. Error | 3 T-value | 4 Signif. |
| 1 1 | 491.637655 | 3.280291 | 149.88 | 0.0001 |
| 2 ~P | 140.611206 | 5.153843 | 27.28 | 0.0001 |
| 3 ~E | 43.321860 | 5.515963 | 7.85 | 0.0005 |
| 4 ~P**2 | −34.642576 | 4.562820 | −7.59 | 0.0006 |
| 5 ~E**2 | −17.400366 | 4.750113 | −3.66 | 0.0145 |
| 6 ~P*E**2 | −9.007258 | 6.311847 | −1.43 | 0.2129 |
| 7 ~P**2*E | 19.793444 | 6.613689 | 2.99 | 0.0303 |

| 0 Term | 5 Transformed Term |
|---|---|
| 1 1 | |
| 2 ~P | ((P-1.5)/1.5) |
| 3 ~E | ((E-2.3256e − 01)/2.3256e − |
| 4 ~P**2 | ((P-1.5)/1.5)**2 |
| 5 ~E**2 | ((E-2.3256e − 01)/2.3256e − |
| 6 ~P*E**2 | ((P-1.5)/1.5)*((E-2.3256 |
| 7 ~P**2*E | ((P-1.5)/1.5)**2*((E-2.3 |

No. cases = 12
R-sq. = 0.9980
RMS Error = 7.273
Resid. df = 5
R-sq-adj. = 0.9956
Cond. No. = 3.871
~indicates factors are transformed.

TABLE 22

| CSF Optimization for Polymer and Enzyme | | | | |
|---|---|---|---|---|
| 0 Factor, Response or Formula | 1 Range | 2 Initial Setting | 3 Optimal Value | |
| Factors | | | | ENZYME |
| POLY_DOSE | 0 | | 0 | ONLY |
| ENZ_DOSE | 0 to 0.46512 | 0.2326 | 0.46512 | |

TABLE 22-continued

| CSF Optimization for Polymer and Enzyme | | | | |
|---|---|---|---|---|
| 0 Factor, Response or Formula | 1 Range | 2 Initial Setting | 3 Optimal Value | |
| Responses | | | | |
| CSF | MAX | | 371.11 | |
| Factors | | | | POLYMER |
| POLY_DOSE | 0 TO 3 | 1.5 | 3 | ONLY |
| ENZ_DOSE | 0 | | 0 | |
| Responses | | | | |
| CSF | MAX | | 508.08 | |
| Factors | | | | POLYMER |
| POLY_DOSE | 0 to 3 | 1.5 | 3 | AND |
| ENZ_DOSE | 0 to 0.46512 | 0.2326 | 0.4641 | ENZYME |
| Responses | | | | |
| CSF | MAX | | 634.27 | |

Converged to a tolerance of 0.039 after 11 steps.

We claim:

1. A process for improving the freeness of paper pulp, which comprises the sequential steps of:

a) Adding to the pulp at least 0.05% based on the dry weight of the pulp, of a cellulolytic enzyme;

b) Allowing the pulp to contact the cellulolytic enzyme for at least 20 minutes at a temperature of at least 20° C.;

c) Adding at least 0.0007% based on the dry weight of the pulp of a water soluble cationic polymer, and then, d) Forming the thus treated pulp into paper.

2. The process of claim 1 where the water soluble cationic polymer is a copolymer which contains from 30% to 80% weight of acrylamide.

3. The process of claim 2 where the cationic acrylamide copolymer is an acrylamide-DADMAC Copolymer.

4. A process for improving the freeness of paper pulp which contains at least 50% by weight of recycled fibers which comprised the sequential steps of:

a) Adding to the pulp at least 0.05% based on the dry weight of the pulp, of a cellulolytic enzyme;

b) Allowing the pulp to contact the cellulolytic enzyme for at least 20 minutes at a temperature of at least 20° C.;

c) Adding at least 0.0007% based on the dry weight of the pulp of a water soluble cationic polymer, and then, d) Forming the thus treated pulp into paper.

5. The process of claim 4, where the cationic polymer contains from 30% to 80% weight of acrylamide.

6. The process of claim 5, where the cationic polymer is an acrylamide-diallyldimethyl ammonium chloride.

* * * * *